United States Patent [19]

King et al.

[11] Patent Number: 4,721,412

[45] Date of Patent: Jan. 26, 1988

[54] OFFSHORE SAFETY ESCAPE PLATFORM

[75] Inventors: Robert D. King, 5400 Mitchelldale, Suite A-3, Houston, Tex. 77092; Steven G. Jennings, Houston, Tex.

[73] Assignee: Robert D. King, Houston, Tex.

[21] Appl. No.: 880,999

[22] Filed: Jul. 1, 1986

[51] Int. Cl.[4] ..... E02D 21/00; B63B 35/44; E01D 1/00

[52] U.S. Cl. ..... 405/195; 405/202; 405/224; 14/71.1; 114/265

[58] Field of Search ..... 405/195, 202–209, 405/220, 224, 227; 166/364; 114/264, 265, 362, 365, 378, 379, 221 A; 14/18, 69.5, 71.1; 182/10, 191

[56] References Cited

U.S. PATENT DOCUMENTS

| | | | |
|---|---|---|---|
| 3,245,101 | 4/1966 | Wilson | 14/18 |
| 3,768,268 | 10/1973 | Laffont et al. | 405/202 |
| 3,961,592 | 6/1976 | Corgnet | 114/221 A X |
| 4,003,473 | 1/1977 | Ryan | 14/71.1 X |
| 4,060,995 | 12/1977 | Lacroix et al. | 405/207 X |
| 4,126,010 | 11/1978 | Michel et al. | 405/202 |
| 4,170,186 | 10/1979 | Shaw | 114/264 |
| 4,227,830 | 10/1980 | Tuson | 405/202 X |
| 4,234,270 | 11/1980 | Gjerde et al. | 405/202 |
| 4,294,331 | 10/1981 | Reynoir et al. | 114/264 X |
| 4,495,849 | 1/1985 | Cooke et al. | 114/221 A X |

*Primary Examiner*—Nancy J. Stodola

*Attorney, Agent, or Firm*—Guy E. Matthews

[57] ABSTRACT

Emergency escape platform apparatus including an escape platform disposed in spaced apart relation from a drilling platform and joined to the drilling platform by escape bridge apparatus. Two flexible base cables are connected in tension horizontally adjacent between the escape platform and the drilling platform. Two flexible hand cables are connected in tension horizontally adjacent to one another and vertically adjacent respectively above the base cables. A plurality of vertical spacer bars are vertically connected between a respective base cable and a respective hand cable at selected intervals. Cable tensioning apparatus connects the base cables and the hand cables for maintaining the cables under selected tension while permitting relative movement between the escape platform and the drilling platform. Light weight walkway structure is horizontally disposed between and connects the base cables to provide a walkway for individuals between the drilling platform and the escape platform. Remotely actuated cable quick release mechanisms releasably connect the base cables and the hand cables. The quick release mechanism is adapted to be actuated by a remotely located radio signal to release the cables. The quick release mechanism may utilize an explosive.

15 Claims, 10 Drawing Figures

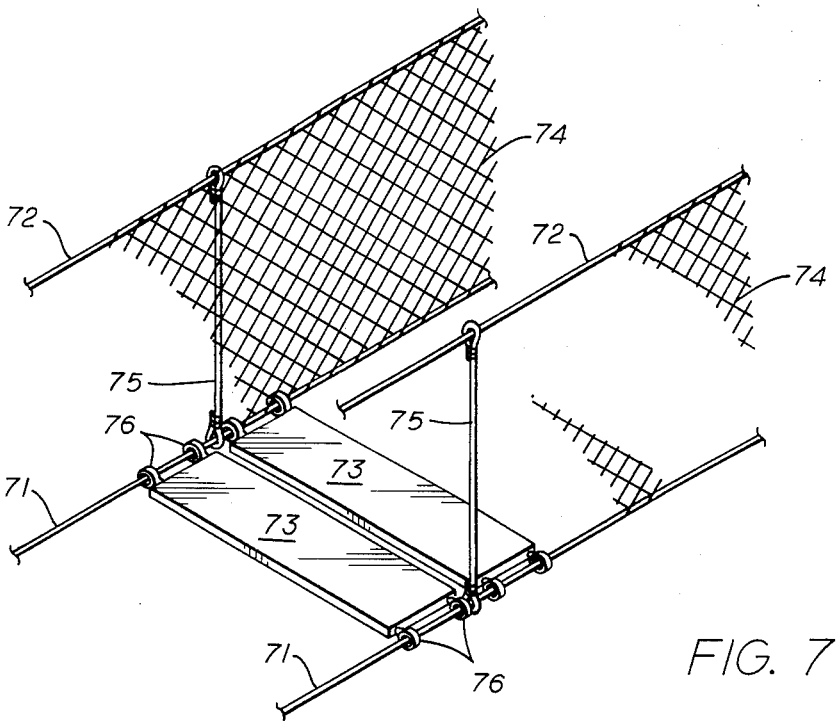
FIG. 7
FIG. 9
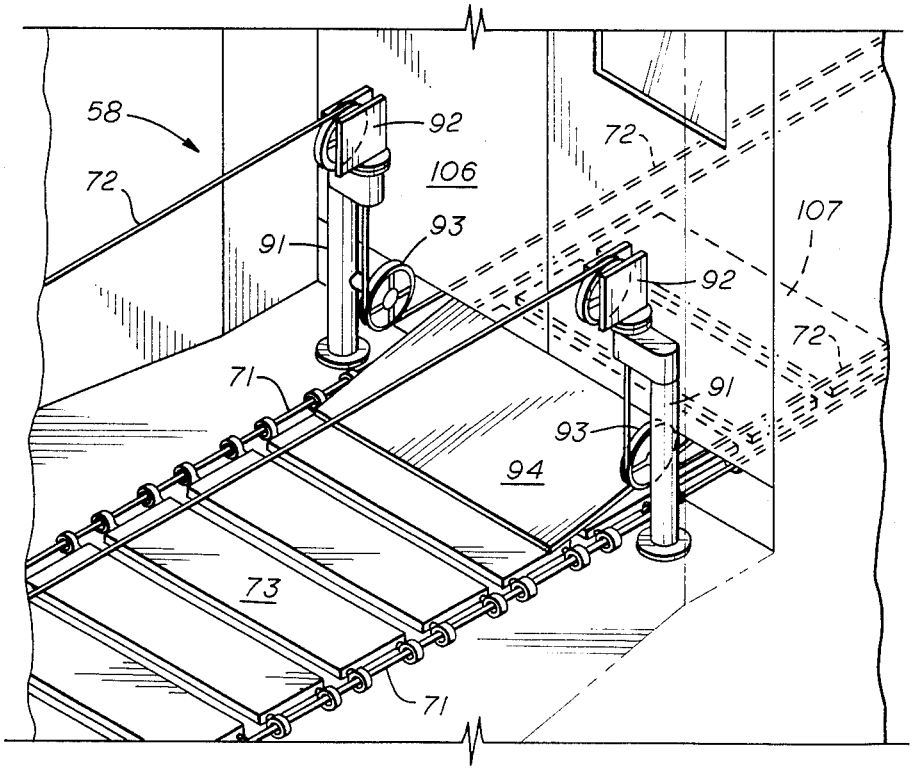

OFFSHORE SAFETY ESCAPE PLATFORM

SUMMARY OF THE INVENTION

The present invention relates essentially to a safety escape platform located adjacent to an offshore drilling platform to provide a safe, remote sanctuary during emergencies on the drilling platform. The invention further relates to a detachable bridge connecting the safety platform to the drilling platform.

BACKGROUND OF THE INVENTION

Large offshore drilling platforms have been used in deep waters for considerable time. Such drilling platforms are used to find and produce hydrocarbons from below the sea floor. The platforms are manned by up to 200 people and living quarters for the crew are generally provided on separate levels of the platform. All of the operational and living quarters are confined to a relatively small area. In case of a fire or other emergency, the crew must be evacuated by boat or by otherwise abandoning the platform. In inclement conditions as are present in the North Sea, such evacuations may be as hazardous as the emergency giving rise to such evacuation. In some cases, the emergency may be caused by the capsizing of the drilling platform itself.

At least one reference has been made to providing remote living quarters for the crew on such a drilling platform. U.S. Pat. No. 4,227,830 issued to Tuson discloses remote living quarters and a connecting bridge. Tuson discloses a complete separate column and platform for all of the living quarters for crew on a drilling platform. As many such drilling or production platforms already provide for living quarters, such a column would be duplicative and expensive. Further, the bridges disclosed by Tuson appear to be complicated and expensive since the safety requires a remoteness of approximately one hundred yards. Further, Tuson discloses no method for remotely and quickly detaching the bridge connecting the two platforms as might be required in case of the drilling platform capsizing.

OBJECTS OF THE INVENTION

In view of the above considerations, it is one object of the present invention to provide a relatively inexpensive escape platform which may be located adjacent to a drilling platform.

Another object of the invention is to provide an escape platform which can be quickly detached from the drilling platform in an emergency.

Yet another object of the invention is to provide an inexpensive, yet a reliable bridge between a drilling platform and a safety escape platform, the bridge being "disposable".

BRIEF DESCRIPTION OF THE DRAWING

FIG. 7 is a detailed section of the bridge of the present invention.

FIG. 9 is a detail of the connection of the bridge to the emergency shelter of the present invention.

DESCRIPTION OF THE PREFERRED EMBODIMENTS

Referring now to the figures in which like components are indicated by like numbers, the details of the present invention are shown.

Figure 1:
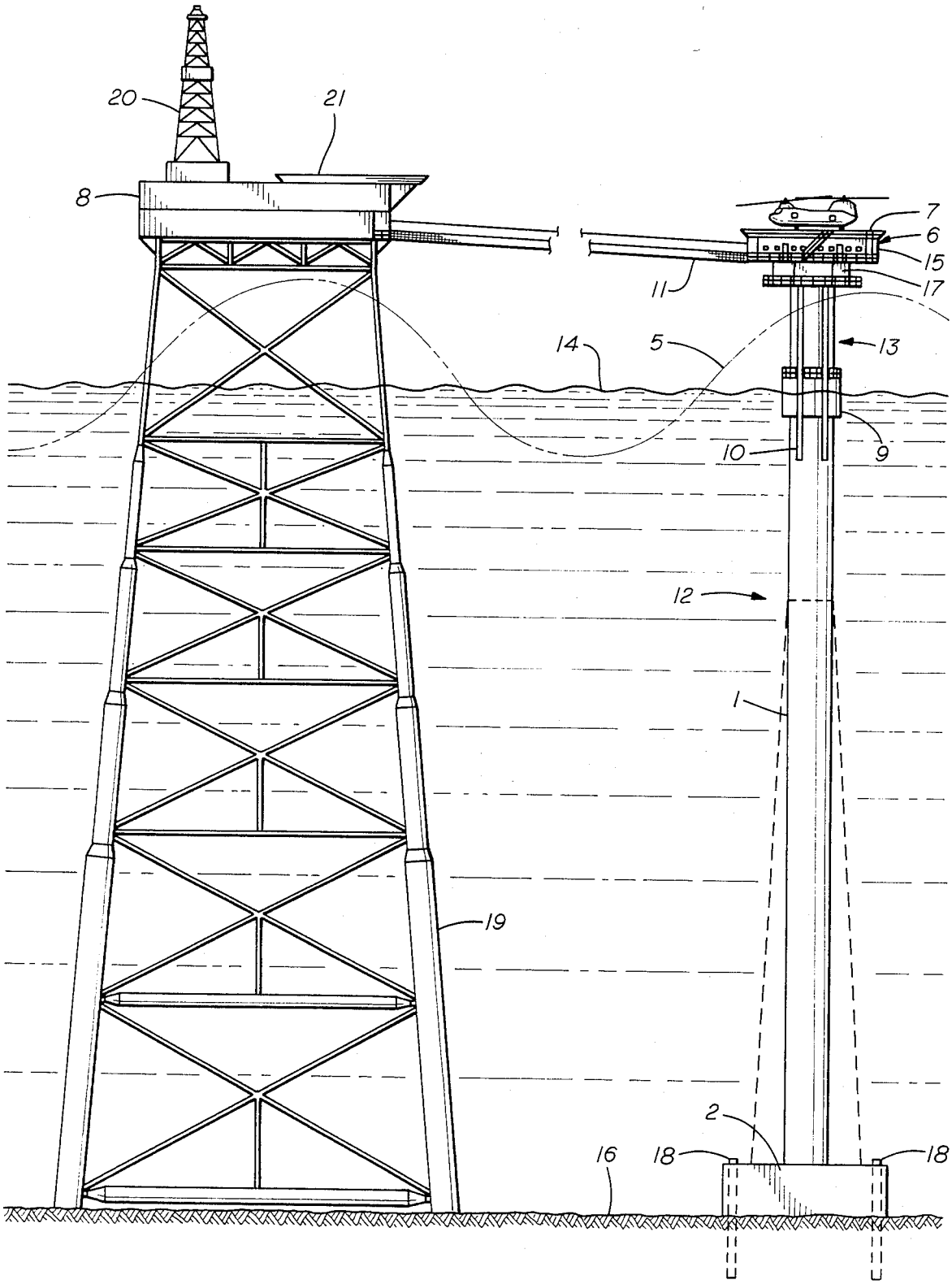
FIG. 1 is an elevational view of the platform of the present invention having a fixed gravity based foundation.
Figure 2:
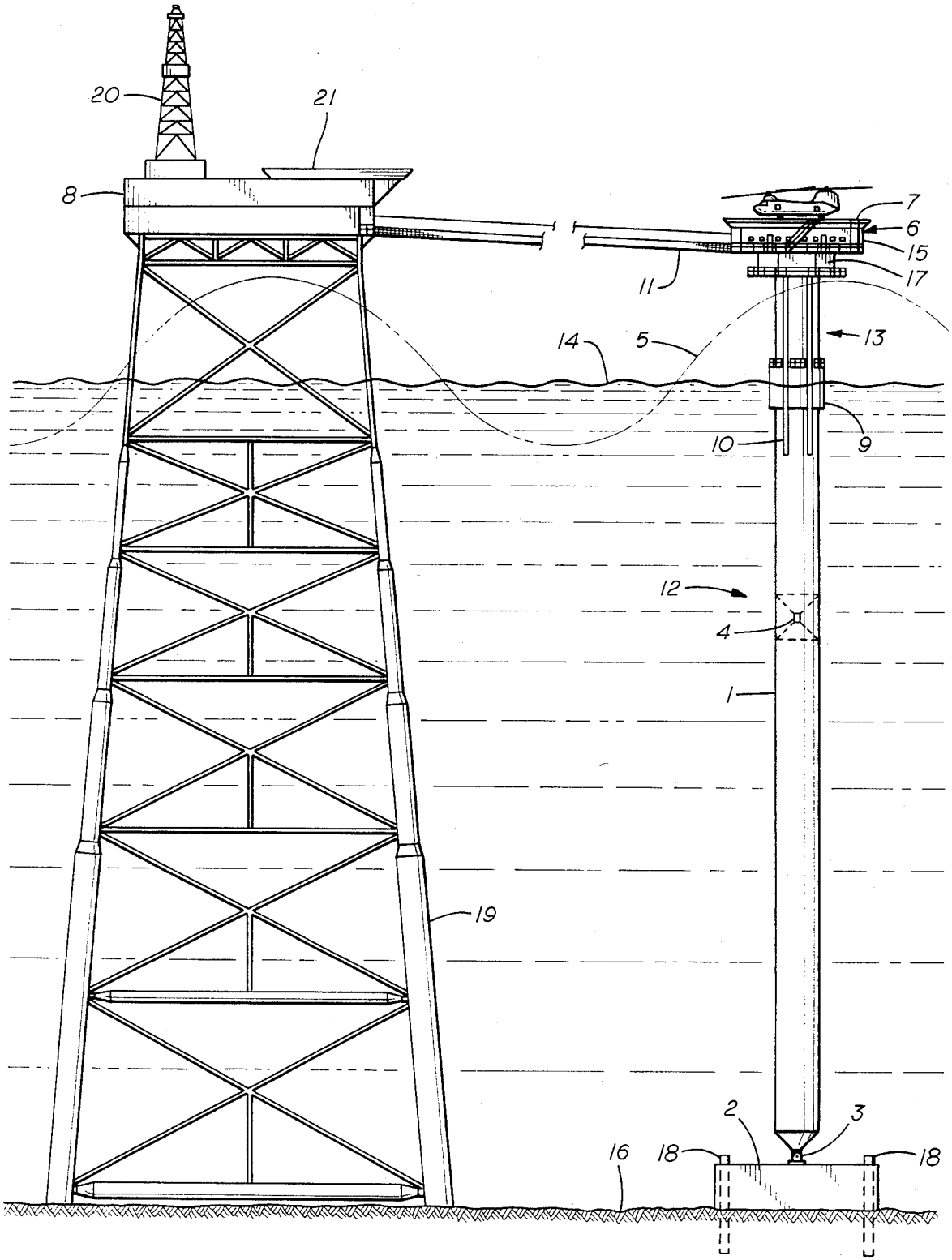
FIG. 2 is an elevational view of the platform of the present invention having an articulated column and base structure.
Figure 3:
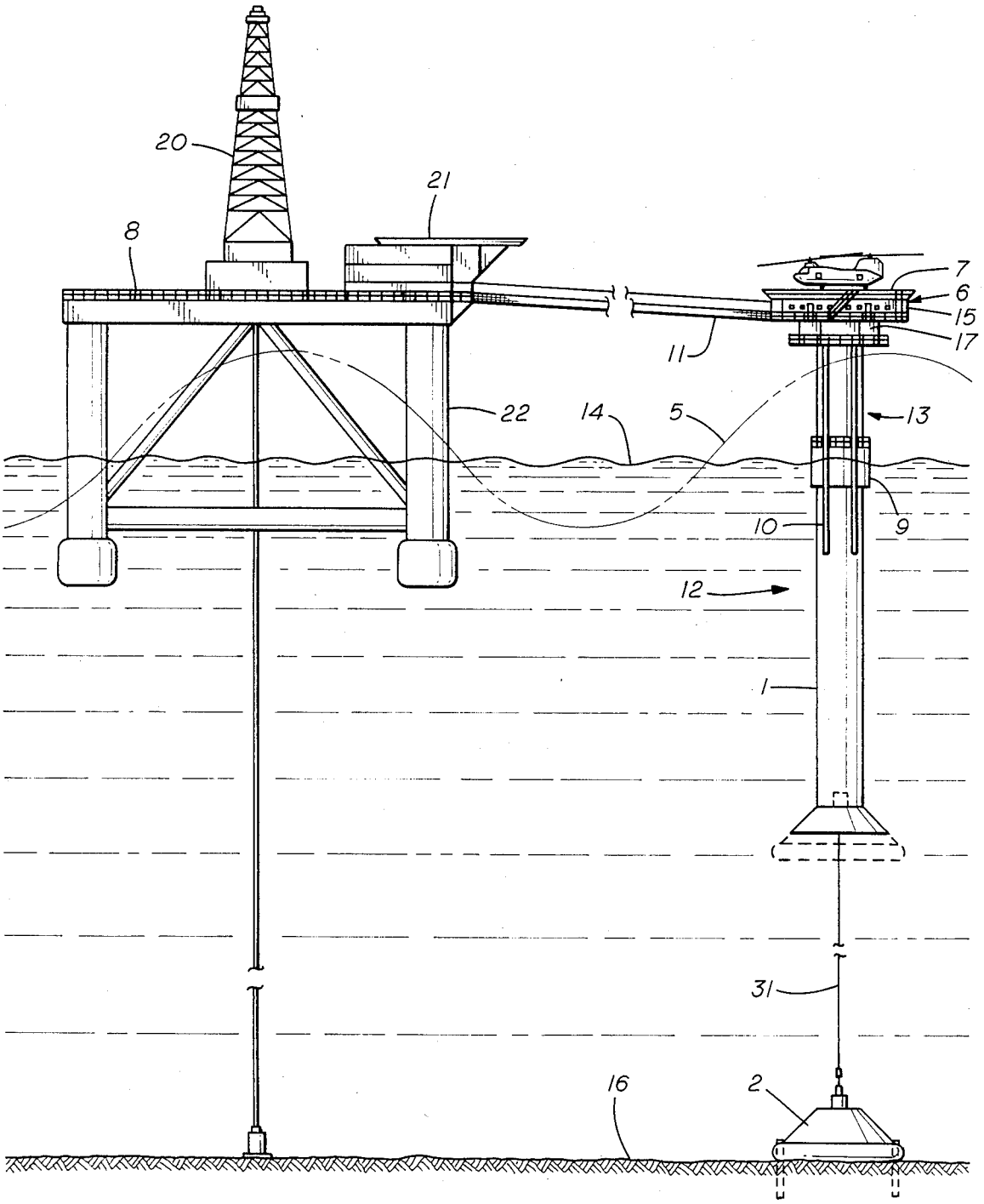
FIG. 3 is an elevational view of the platform of the present invention having a single anchor leg tension connection to the gravity base.
Figure 4:
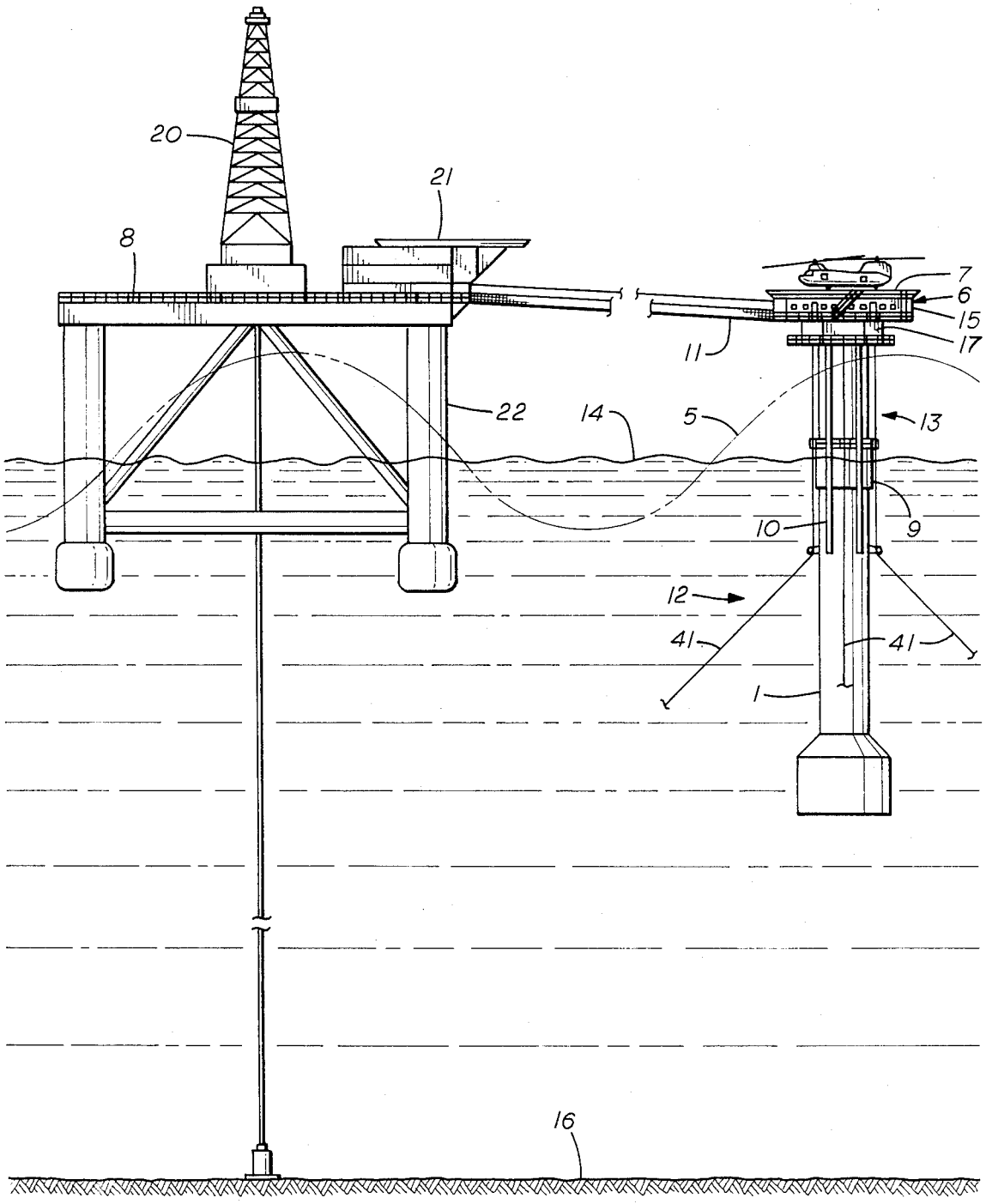
FIG. 4 shows an elevational view of the platform of the present invention having a catenary anchor system connecting the platform to the sea floor.

FIGS. 1–4 show the emergency platform 6 located adjacent a drilling or production platform 8—FIGS. 1 and 2 show embodiments of the present invention as may be used with a drilling platform 8 supported by fixed legs 19 resting on the sea floor 16. FIGS. 3 and 4 illustrate embodiments as may be used with a drilling platform 8 of the semi-submersible type supported by flotation caissons 22. Both types of drilling platform generally have helicopter decks indicated at 21 and a drilling rig 20. The location of the drilling rig 20 on the platform 8 may vary with individual designs.

In the embodiment shown in FIG. 1, a support column 1 is supported on a gravity foundation 2 which is located on the sea floor 16. Piles 18 may be used to secure the foundation to the sea floor if necessary. The column 1 has a submerged section 12 and an emergent section 13. The emergent section 13 extends above the sea surface 14 sufficient to support the emergency escape platform 6 above the maximum wave height indicated as 5. The submerged section 12 may be partially flooded to add stability. The emergency escape platform 6 is connected to the drilling platform 8 by a bridge 11.

The support column is provided with boat fenders 9 and access ladders 10. Helicopter deck 7 is provided on top of the platform 6 to facilitate evacuation. Additionally, a personnel level 15 and machine level 17 are also indicated.

The column 1 and platform 6 are located approximately 100 yards from the drilling platform 8 to provide a completely safe haven in case of emergencies on the drilling platform. FIGS. 2–4 indicate other embodiments of the column showing alternate means for anchoring the column 1 to the sea floor. The embodiment shown in FIG. 2 may be used in deeper water. The articulation provided by the universal joints 3 and 4 to compensate for wave action.

FIGS. 3 and 4 show the escape platform 6 supported by column 1 which are secured to the sea floor by alternate means. For example, FIG. 3 indicates support column 1 attached to a gravity foundation 2 by a chain 31, while FIG. 4 shows catenary type anchor chains 41 being used to secure the column 1 to the sea floor (anchor not shown). The configurations are chosen depending upon the depth, wave action and sea floor conditions at the location in which the platform is to be used.

Figure 5:
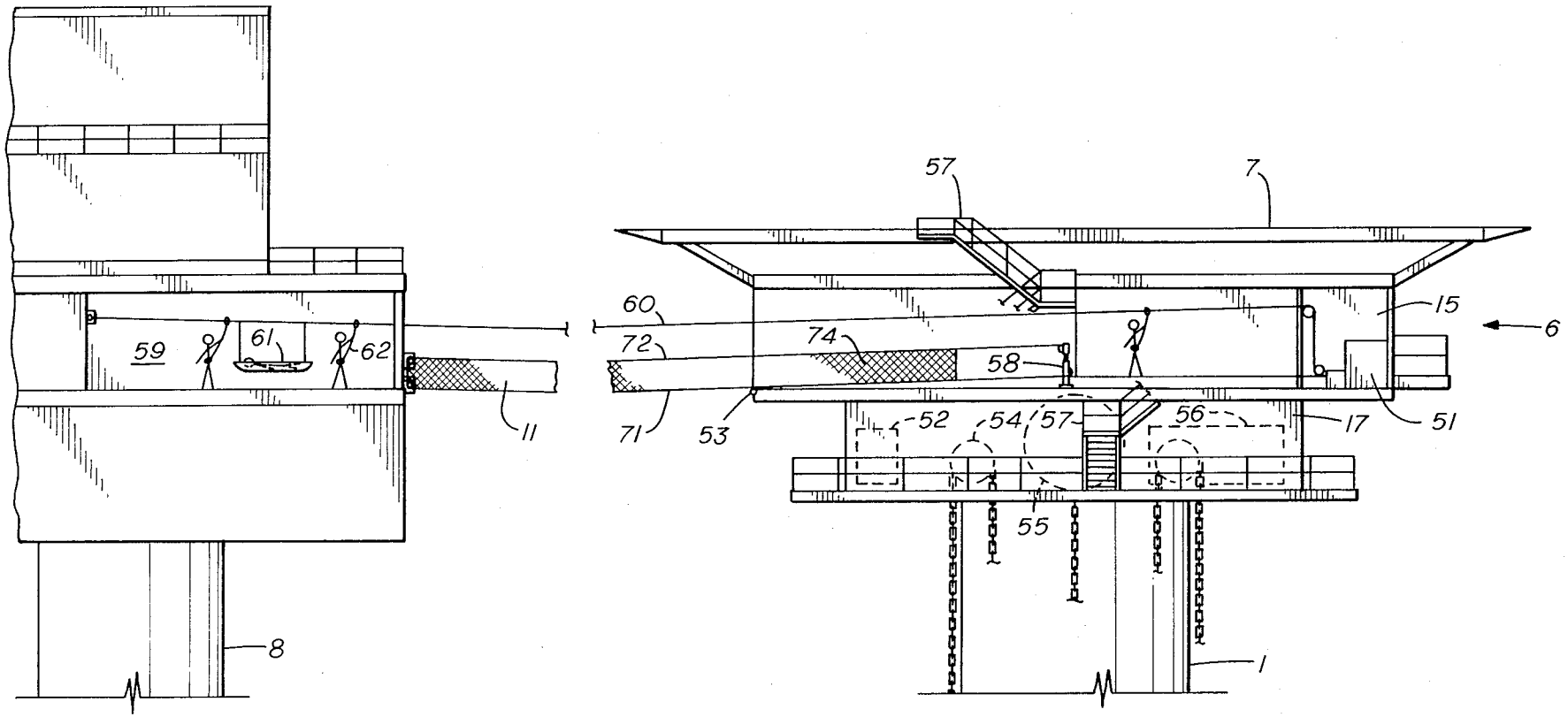
FIG. 5 is an elevational view of the platform and bridge of the present invention.
Figure 10:
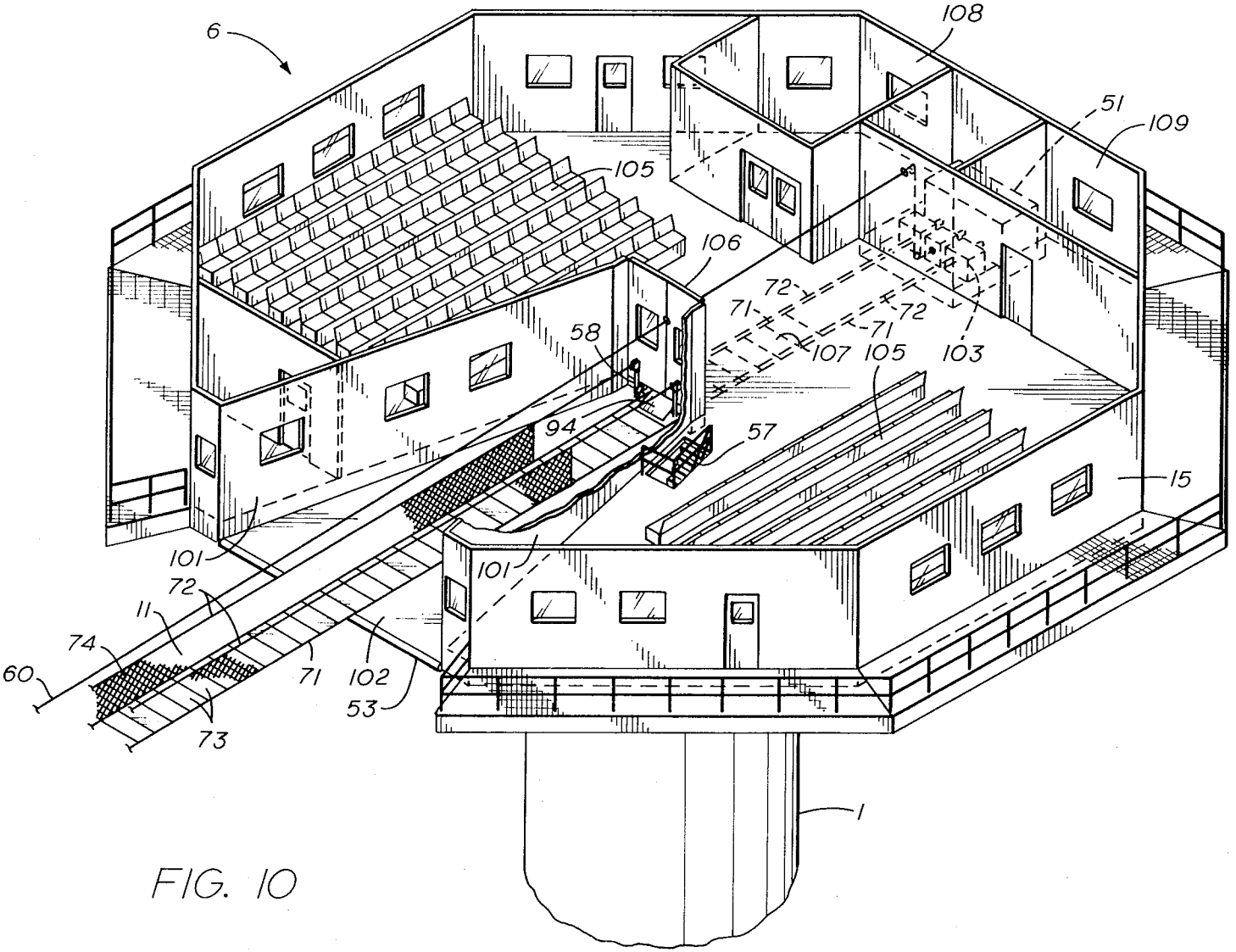
FIG. 10 is a isometric view of the bridge connection and emergency shelter of the present invention.

Referring now to FIG. 5, details of the escape platform 6, staging area on the drilling platform 59 and the bridge 11 are shown. The escape platform 6 includes a personnel level 15, a machinery level 17, and a helicopter deck 7. The machinery level 17 includes the necessary machines for operation of the entire platform including such equipment as anchor winches 54, foot bridge cable deployment spools 55, emergency generators 56 and communication equipment 52. Stairs 57 are shown for communications between the different levels. As shown in FIGS. 5, 9, and 10, the bridge 11 is shown having a cable support system 58 and a tensioning system 51 for the individual cables. One such type of tensioning system is manufactured by Rucker as is commonly used on offshore platforms. The bridge crosses a roller 53 where it connects to the escape platform 6.

Referring now to FIG. 7, a sectional isometric view of the bridge 11 is shown. Base cables 71 are strung in parallel relation to one another. Directly above the base cables 71, hand cables 72 are strung. Between each of the cables 71 and 72, nylon or other lightweight webbing 74 is stretched and firmly attached to provide a safety device to prevent falling between the hand cable 72 and the foot bridge. Additionally, spacer bars 75 are disposed between cables 71 and 72 at intervals to maintain the cables in fixed relation to one another. Individual aluminum, fiberglass or other lightweight walkway materials 73 are fixed firmly to the two base cables 71 by eye bolts 76 to provide a safe walkway and to allow for catenary sag and movement.

Referring now to FIG. 9, more detail of the cable attachment means 58 on the platform 6 as shown. The support cables 71 pass straight through to the tensioning devices (not shown). However, the upper cable or hand cables 72 pass over a fairlead 92 and then downward to a sheave 93 which directs the cables to the tensioning devices. The fairleads 92 are supported on the columns 91, such that each of the fairleads may swivel in a horizontal plane to compensate for movement due to wave action. A roller supported hinged toe plate 94 is provided for smooth transition between the bridge and the platform.

Figure 6:
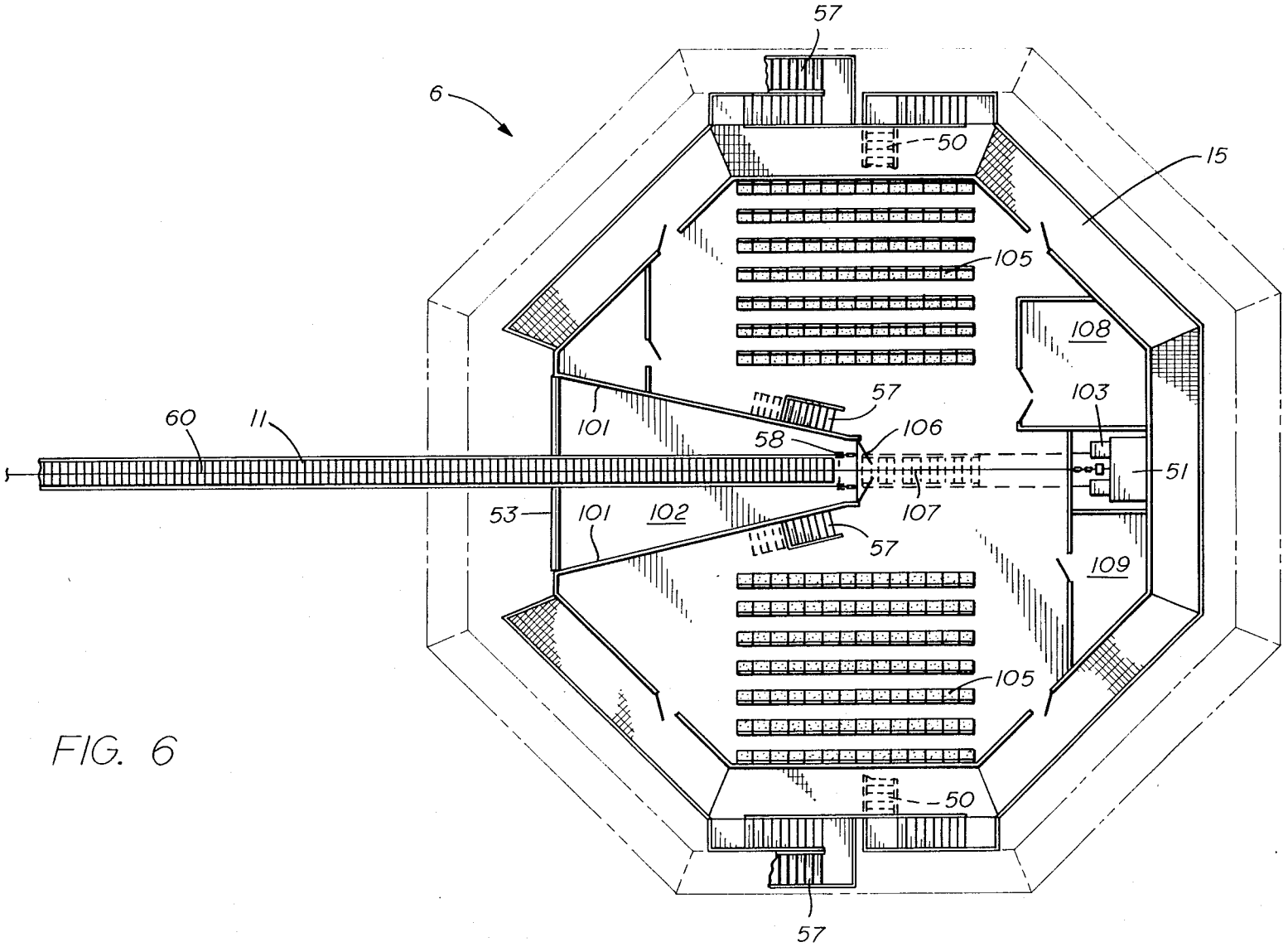
FIG. 6 is a plan view of the emergency shelter provided in the present invention.

Referring now to FIGS. 6 and 10, plan and isometric views of the platform 6 is shown along with the bridge connecting the platform 6 with the drilling platform. The bridge 11 is shown passing under the deck at 107 where the bridge may travel allowing for a flat deck over the entire walking surface. Toe plate 94 provides a stable area for stepping and entering through the swinging doors 106 which provide access to the personnel level 15. The deckway 102 where the bridge enters the personnel level 15 is slanted to allow for catenary sag and vertical movement between the bridge and deck. Similarly, the bulkheads 101 on either side of the entrance are angled to allow for limited yawing motion due to wave action. The roller 53 allows the bridge to move smoothly with the wave action.

Figure 8:
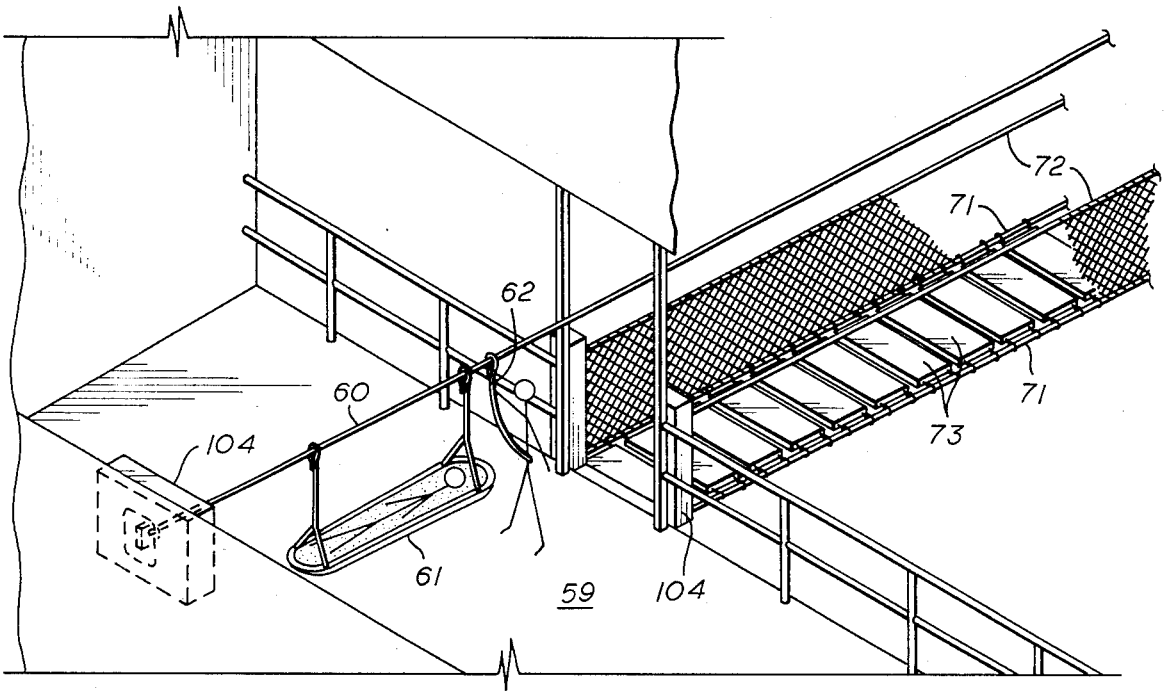
FIG. 8 is a detail of the connection of the bridge to the staging area on the drilling platform.

Referring now to FIG. 8 the attachment of the bridge to the drilling platform 8 at the staging area 59 is shown. An overhead cable 60 is provided for extra safety and for use with a trolley to transport injured personnel or an individual safety harness 62. Primary shear devices are shown at 104. The primary shear devices 104 are remotely controlled by radio from the personnel level of the platform 6. The shearing devices completely shear all of the cables 60, 71 and 72 to release the bridge from the drilling platform. Shearing devices are of the explosive type which are commonly used in the industry. Secondary bridge shearing devices are shown at 103 in FIG. 10 which may be actuated from inside the personnel level 15. Suitable shearing devices are available from Jet Research Center, Inc., Arlington, Texas. A cable tensioning system for each of the cables 51 is shown inside the personnel level and keeps the bridge taut and compensates for wave motion to provide a safe, stable bridge. Personnel level 15 on the platform 6 is shown to have seating capacity 105 for approximately 200 individuals with emergency provisions provided thereunder. First aid station 108 and hygiene facilities 109 are also provided on the personnel level.

From the foregoing, it may be seen that a completely safe and relatively inexpensive emergency escape platform has been provided. Although preferred embodiments are shown, it should be understood that the invention is limited only by the appended claims.

What is claimed is:

1. Emergency escape platform apparatus comprising:

(a) an escape platform disposed in spaced apart relation from a drilling platform;

(b) two flexible base cables connected horizontally adjacent to one another and in tension between said escape platform and said drilling platform;

(c) two flexible hand cables conneted (1) horizontally adjacent to one another; (2) vertically adjacent respectively above said base cables; and (3) in tension between said escape platform and said drilling platform;

(d) spacer bar means vertically connecting a respective base cable to a respective hand cable at selected intervals;

(e) walkway means horizontally disposed between and connecting said two base cables to provide a walkway for crew members between said drilling platform and said escape platform;

(f) cable tensioning means in connection with said base cables and said hand cables for respectively maintaining said cables under selected tension while permitting relative movement between said escape platform and said drilling platform;

(g) cable releasing means in respective connection with said base cables and said hand cables for releasing all said cables when desired.

2. The escape platform of claim 1 comprising:

(a) anchor means to anchor said safety platform to the sea floor; and (b) a column supporting said escape platform and connected to said anchor means, said column having a submergent section and an emergent section, said emergent section extending above the sea surface sufficient to clear the maximum wave height in the location of said working platform.

3. The emergency escape platform of claim 2 further comprising:

(a) a machinery level housing power generation facilities and equipment used in locating and anchoring said escape platform;

(b) a personnel level located above said machinery level housing seating for all crew members on said drilling platform, a first aid station and hygiene facilities; and (c) a landing platform for helicopters located on top of said personnel level to facilitate evacuation of the crew members.

4. The emergency platform of claim 2 wherein said anchor means comprises a gravity foundation and said column is connected to said foundation through a universal joint.

5. The emergency escape platform of claim 4 wherein said support column includes a second universal joint intermediate to said foundation and said escape platform to provide additional stability in the vertical plane to compensate for wave action.

6. The emergency escape platform of claim 2 wherein said anchor means comprises a gravity foundation and said column is fixedly attached to said foundation.

7. The emergency escape platform of claim 2 wherein said anchor means comprises a gravity foundation and said column is connected to said foundation by an anchor chain.

8. The emergency escape platform of claim 2 wherein said anchor means comprises a plurality of catenary anchors.

9. The emergency escape platform of claim 1 wherein said releasing means comprises a first shearing means for each of said cables located on said drilling platform and a second shearing means for each of said cables located on said emergency escape platform, said first shearing means being remotely activated from said emergency escape platform.

10. The emergency safety escape platform of claim 1 comprising:

(a) a gravity foundation to anchor said safety platform to said sea floor;

(b) an articulated support column supporting said escape platform and connected to said foundation through a universal joint, said column having a submergent section and an emergent section, said emergent section extending above the sea surface sufficient to clear the maximum wave height in the location of said working platform; and (c) an emergency shelter supported by said column, said shelter having the necessary amenities for survival of crew members.

11. The escape platform of claim 1 comprising:

(a) gravity foundation to anchor said safety platform to the sea floor;

(b) a support column supporting said escape platform and anchored by a chain to said foundation, said column having a submergent section and an emergent section, said emergent section extending above the sea surface sufficient to clear the maximum wave height in the location of said drilling platform; and (c) an emergency crew member shelter supported by said platform.

12. The safety escape platform of claim 1 including a support column supporting said escape platform and anchored by a plurality of catenary cables to the sea floor.

13. The apparatus of claim 1 further including overhead safety cable means connected in tension vertically adjacent to and above said walkway, said overhead safety cable means also being connected with said cable tensioning means and with said cable quick release means.

14. The apparatus of claim 1 wherein said cable releasing means is adapted to be remotely actuated by a radio signal to release said cables.

15. The apparatus of claim 1 wherein said cable releasing means utilizes an explosive.

* * * * *